US005596962A

United States Patent [19]

Tsunoda et al.

[11] Patent Number: 5,596,962

[45] Date of Patent: Jan. 28, 1997

[54] INTAKE SILENCER IN VERTICAL TYPE ENGINE

[75] Inventors: Masaki Tsunoda; Tetsu Wada, both of Wako, Japan

[73] Assignee: Honda Giken Kogyo Kabushiki Kaisha, Tokyo, Japan

[21] Appl. No.: 533,773

[22] Filed: Sep. 26, 1995

[30] Foreign Application Priority Data

Sep. 26, 1994 [JP] Japan ..... 6-230073

[51] Int. Cl.[6] ..... F02M 35/12

[52] U.S. Cl. ..... 123/184.39; 123/184.53; 123/195 HC

[58] Field of Search ..... 123/184.23, 184.25, 123/184.39, 184.43, 184.48, 184.53, 195 HC, 184.46, 184.38

[56] References Cited

U.S. PATENT DOCUMENTS 5,488,939 2/1996 Nakai et al. ..... 123/184.35
5,492,089 2/1996 Hiraoka et al. ..... 123/184.47
5,513,606 5/1996 Shibata ..... 123/184.34

FOREIGN PATENT DOCUMENTS 4-1661 1/1992 Japan .
4-91360 3/1992 Japan ..... 123/184.48

*Primary Examiner*—David A. Okonsky
*Attorney, Agent, or Firm*—Nikaido, Marmelstein, Murray & Oram LLP

[57] ABSTRACT

An intake silencer of a vertical-type engine includes two silencing chambers. A first intake silencing chamber is disposed adjacent to the body of the engine; a second intake silencing chamber is located upstream in a flow of intake air from the first intake silencing chamber, and receives the flow of intake air as input thereto. An output of the second intake silencing chamber becomes an input to the first intake silencing chamber. The second intake silencing chamber is disposed at an opposite end of the engine body from the cylinder head of the engine.

10 Claims, 7 Drawing Sheets

FRONT VIEW

INTAKE SILENCER IN VERTICAL TYPE ENGINE

BACKGROUND OF THE INVENTION

1. Field of the Invention

The present invention relates to an intake silencer in a vertical type engine having a crankshaft vertically disposed therein, and wherein the engine is configured to be accommodated in an engine room or compartment, or accommodated in an area with limited space.

2. Description of the Prior Art

There is a conventionally known intake silencer in a vertical type engine, as disclosed in Japanese Utility Model Application Laid-Open No. 1661/92. In this conventional intake silencer, the vertical type engine having the crankshaft vertically disposed therein is accommodated within the engine room, and an intake silencing chamber is disposed in a space defined along one side of a crankcase of the engine.

To enhance the silencing effect, it is desired to possibly increase the volume of the intake silencing chamber. However, there is a limit to the space within the engine compartment or room in which the engine and various auxiliaries can be accommodated. For this reason, if the intake silencing chamber is only disposed in the space defined along one side of the crankcase of the engine, it is difficult to ensure a sufficient volume of the intake silencing chamber.

SUMMARY OF THE INVENTION

Accordingly, it is an object of the present invention to ensure the sufficient volume of the intake silencing chamber accommodated within the engine room, to enhance the silencing effect.

To achieve the above object, according to a first aspect and feature of the present invention, there is provided an intake silencer in a vertical type engine, which is provided in the engine having a crankshaft vertically disposed therein and which is accommodated in an engine compartment, the intake silencer comprising a first intake silencing chamber located downstream in a direction of flow of an intake air, and a second intake silencing chamber located upstream in the flow direction, the first intake silencing chamber being disposed along a side of an engine body, and the second intake silencing chamber being disposed along an opposite end of the engine body from a cylinder head.

With the first feature of the present invention, it is possible to ensure sufficient volumes of the intake silencing chambers by utilizing a space defined along the side of the engine body and a space defined along the opposite end of the engine body from the cylinder head.

According to a second aspect and feature of the present invention, in addition to the first feature, the second intake silencing chamber includes a first portion extending upwardly and having a lower end which opens into the engine room, and a second portion which is horizontally curved from the first portion and which is connected to the first intake silencing chamber.

With the second feature of the present invention, it is possible not only to ensure a sufficient volume of the second intake silencing chamber, but also to prevent water from entering into an intake system by the fact that the first portion, into which intake air is introduced, opens downwardly into the engine room.

BRIEF DESCRIPTION OF THE DRAWINGS

The above and other objects, features and advantages of the invention will become apparent from the following description of preferred embodiments taken in conjunction with the accompanying drawings, wherein.

DESCRIPTION OF THE PREFERRED EMBODIMENTS

Figure 1:
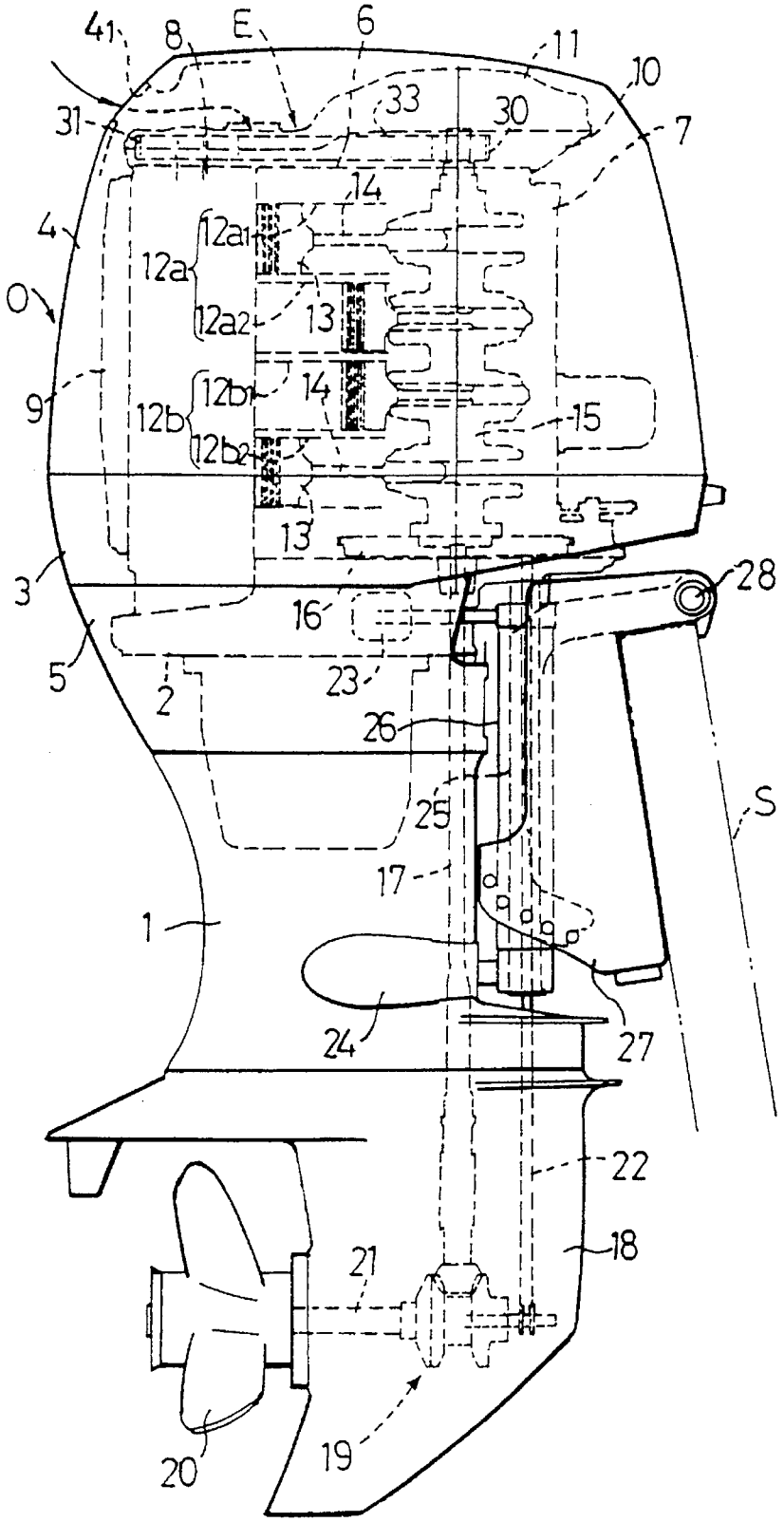
FIG. 1 is a side view of an outboard motor which incorporates an intake silencer according to a first embodiment of the present invention.

Referring to FIG. 1, an outboard motor O includes a mount case portion 2 coupled to an upper portion of an extension case 1. A serial 4-cylinder and 4-cycle engine E is supported on an upper surface of the mount case portion 2. An under-case portion 3 having an upper surface opened is coupled to the mount case portion 2, and an engine cover 4 is detachably mounted on an upper portion of the under-case portion 3. An under-cover 5 is mounted between a lower edge of the under-case portion 3 and an upper edge of the extension case 1 to cover the outside of the mount case portion 2.

The engine E includes a cylinder block 6, a crankcase 7, a cylinder head 8, a head cover 9, a lower belt cover 10 and an upper belt cover 11. The cylinder block 6 and the crankcase 7 are supported on the upper surface of the mount case portion 2. A piston 13 is slidably received in each of four cylinders $\mathbf{12}a_1$, $\mathbf{12}a_2$, $\mathbf{12}b_1$ and $\mathbf{12}b_2$ which are defined in the cylinder block 6. Each of the pistons 13 are connected to a vertically disposed crankshaft 15 through a connecting rod 14. The upper two cylinders $\mathbf{12}a_1$ and $\mathbf{12}a_2$ constitute a first cylinder group 12*a*, and the lower two cylinders $\mathbf{12}b_1$ and $\mathbf{12}b_2$ constitute a second cylinder group 12*b*. In addition, the cylinder block 6 and the crankcase 7 constitute an engine body.

A driving shaft 17 is connected to a lower end of the crankshaft 15 along with a flywheel 16, and extends downwardly within the extension case 1. A lower end of the driving shaft 17 is connected to a propeller shaft 21 having a propeller 20 at a rear end thereof, through a bevel gear mechanism 19 provided within a gear case 18. A lower end of shifting rod 22 is connected to a front portion of the bevel gear mechanism 19 in order to change the rotational direction of the propeller shaft 21.

A swivel shaft 25 is fixed between an upper mount 23 provided in the mount case portion 2 and a lower mount 24 provided in the extension case 1, and a swivel case 26 for rotatably supporting the swivel shaft 25 is vertically swingable on a stern bracket 27 mounted at a stern S through a tilting shaft 28.

A single cam shaft 29 (see FIG. 4), parallel to the crankshaft 15 is rotatably supported in the cylinder head 8, and a timing belt 33 is received over a crank pulley 30 mounted at an upper end of the crankshaft 15 and a cam pulley 31 mounted at an upper end of the cam shaft 29. The cam pulley 31, the tension pulley 32 and the timing belt 33 are accommodated within the lower and upper belt cover 10 and 11.

Figure 3:
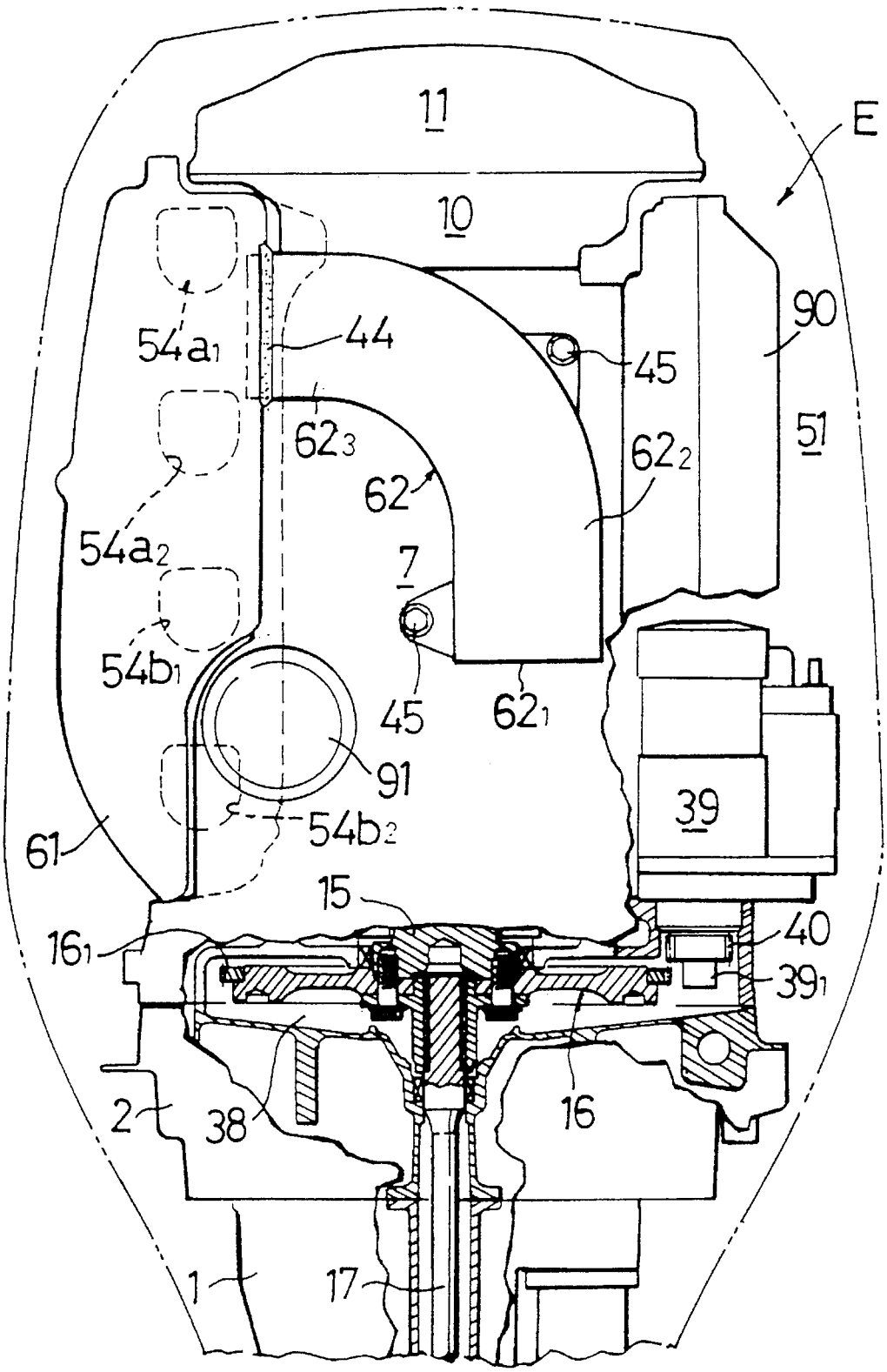
FIG. 3 is a view taken along an arrow 3 in FIG. 2.

As can be seen from reference to FIG. 1 and FIG. 3, the flywheel 16 is accommodated in a flywheel accommodating chamber 38 which is defined by the cylinder block 6, the crankcase 7 and the mount case portion 2, and a plunging-type pinion 40 is provided on an output shaft $\mathbf{39}_1$ of a stator motor 39 and meshably opposed to a gear $\mathbf{16}_1$ formed around an outer periphery of the flywheel 16.

In FIG. 3, reference character 90 is an electric equipment box, and reference character 91 is an oil filter.

The structure of an intake system of the engine E will be described below with reference to FIGS. 2 and 3.

An intake manifold 53 is coupled to a right side of the cylinder head 8 of the engine accommodated in an engine compartment or room 51 defined within the engine cover 4, and has four intake passages 52 integrally provided therein to correspond to the four cylinders $\mathbf{12}a_1$ and $\mathbf{12}a_2$, $\mathbf{12}b_1$ and $\mathbf{12}b_2$, respectively. Each of the intake passages 52 is curved forwardly, and four carburetors $\mathbf{54}a_1$, $\mathbf{54}a_2$, $\mathbf{54}b_1$ and $\mathbf{54}b_2$ are connected to front end of the intake passages 52, respectively.

A throttle valve and a choke valve (both not shown) are accommodated in each of the carburetors $\mathbf{54}a_1$, $\mathbf{54}a_2$, $\mathbf{54}b_1$, and $\mathbf{54}b_2$ so that throttle valve levers 56 coupled to valve stems 55 of throttle valves are driven in operative association with one another by a common link 57, and choke valve levers 59 coupled to valve stems 58 of the choke valves are driven in operative association with one another by a common link 60.

Upstream ends of the four carburetors $\mathbf{54}a_1$, $\mathbf{54}a_2$, $\mathbf{54}b_1$, and $\mathbf{54}b_2$ are connected to a porous-type first intake silencing chamber 61 disposed along a right side of the crankcase 7 of the engine E. The first intake silencing chamber 61 is comprised of a base plate $\mathbf{61}_1$ which supports the carburetors $\mathbf{54}a_1$, $\mathbf{54}a_2$, $\mathbf{54}b_1$ and $\mathbf{54}b_2$ and air horns or intakes 41, and a main body $\mathbf{61}_2$ which defines a silencing space by cooperation with the base plate $\mathbf{61}_1$. The air horns 41 extend within the first intake silencing chamber 61 and have meshes (i.e., flame traps) 42 provided at their tip ends. Alternatively, the mesh 42 may be provided at an intake bore 62, of a duct-type second intake silencing chamber 62 which will be described below. A drain pipe 43 is mounted at a lower end of the first intake silencing chamber 61 for discharging oil which may accumulate in the first intake silencing chamber 61.

The duct-type second intake silencing chamber 62, which is connected to an upstream side of the first intake silencing chamber 61, is coupled through a grommet 44 to a space defined along an opposite side of the crankcase 7 from the cylinder head 8, i.e., a front space in the engine room 51 and is fixed to a front surface of the crankcase 7 by two bolts 45, 45. The second intake silencing chamber 62 includes a first portion $\mathbf{62}_2$ extending upwardly from the intake bore $\mathbf{62}_1$ which opens downwardly, and a second portion $\mathbf{62}_3$ which is curved horizontally through 90° from the first portion $\mathbf{62}_2$ and connected to a left side of an upper portion of the first intake silencing chamber 61.

Figure 2:
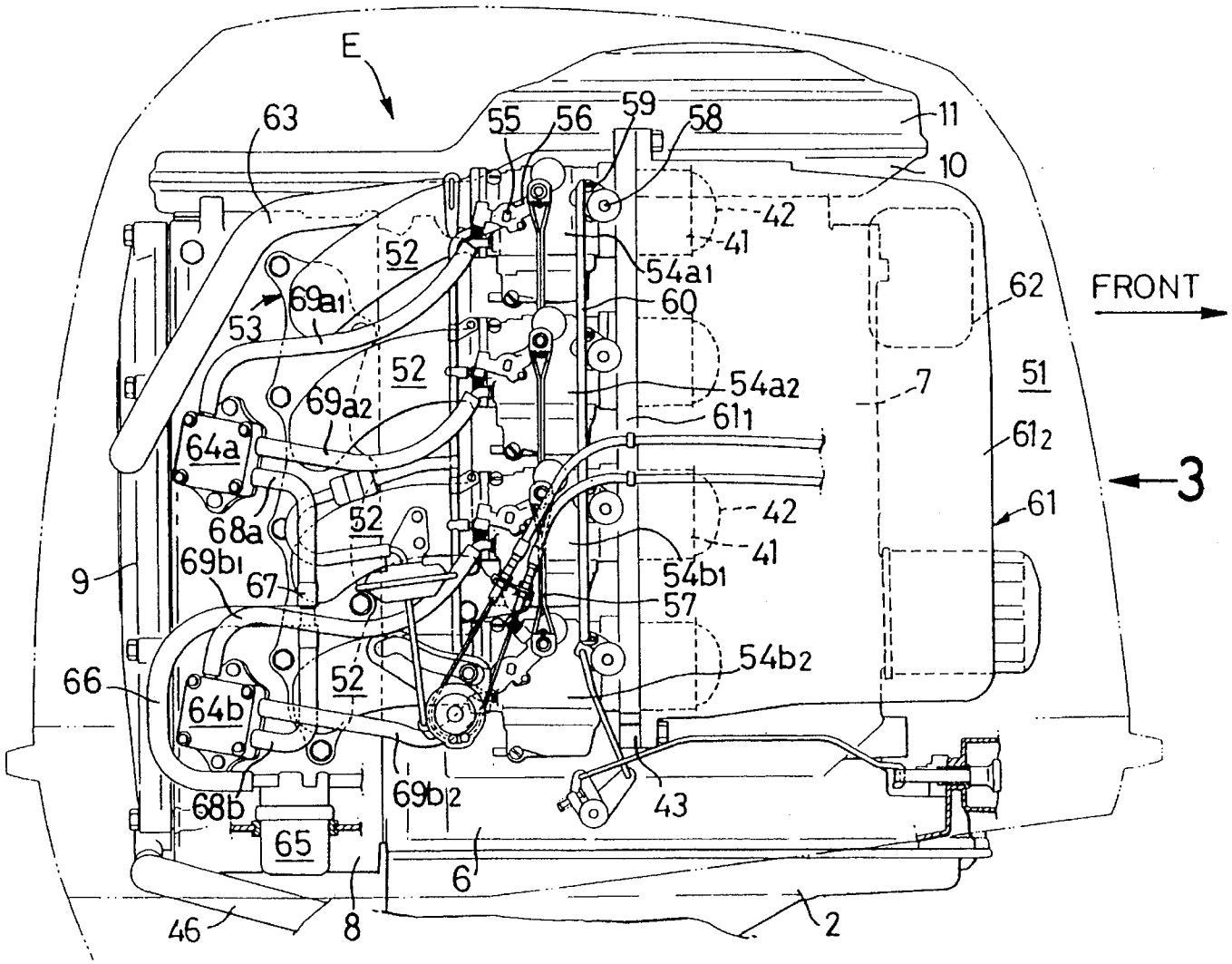
FIG. 2 is an enlarged view of an essential portion shown in FIG. 1.

In FIG. 2, reference character 63 is a breather pipe which interconnects the head cover 9 and the first intake silencing chamber 61, and reference character 46 is an oil return hose.

As described above, the first intake silencing chamber 61 is disposed utilizing the space defined along the right side of the crankcase 7, and the second intake silencing chamber 62 is disposed utilizing the space defined along the front surface of the crankcase 7. Therefore, it is possible to ensure a sufficient total volume of the intake silencing chamber 61 and 62 to effectively prevent intake noise. Moreover, it is possible not only to ensure a large volume within the limited space, because the second intake silencing chamber 62 includes the first portion $\mathbf{62}_2$ curved through 90°, and the second portion $\mathbf{62}_3$; also it is also possible to reliably prevent water from entering the intake system, because the intake bore $\mathbf{62}_1$ opens downwardly.

In addition, since the second intake silencing chamber 62 is provided to enhance the silencing effect, a porous member accommodated within the first intake silencing chamber 61 can be changed, reduced in size, or omitted. Moreover, the first intake silencing chamber 61 is defined to largely project forwardly in order to connect the second intake silencing chamber 62 and therefore, the length of the air horns 41 accommodated within the first intake silencing chamber 61 can be set at a large value. Thus, it is possible not only to set the silencing characteristic as desired, but also to facilitate the catching of blown-back air from the carburetors $\mathbf{54}a_1$, $\mathbf{54}a_2$, $\mathbf{54}b_1$ and $\mathbf{54}b_2$ by the air horns 41. Further, since the first and second intake silencing chambers 61 and 62 are disposed perpendicular to each other, the blown-back air from the carburetors $\mathbf{54}a_1$, $\mathbf{54}a_2$, $\mathbf{54}b_1$ and $\mathbf{54}b_2$ can be accumulated in the first intake silencing chamber 61.

The structure of a fuel supplying system of the engine E will be described below with reference to FIG. 2.

A first fuel pump 64*a* and a second fuel pump 64*b* are mounted on the right side of the cylinder head 8 of the engine E, and a fuel tank (not shown) is connected to intake ports of the two fuel pumps 64*a* and 64*b* through a fuel filter 65, a fuel supply pipe 66, a joint 67, and fuel supply pipes 68*a* and 68*b*.

A discharge port of the upper first fuel pump 64*a* is connected to the carburetors $\mathbf{54}a_1$ and $\mathbf{54}a_2$ for the two cylinders $\mathbf{12}a_1$ and $\mathbf{12}a_2$ of the upper first cylinder group 12*a* through fuel supply pipes $\mathbf{69}a_1$ and $\mathbf{69}a_2$, while a discharge port of the lower second fuel pump 65*b* is connected to the carburetors $\mathbf{54}b_1$ and $\mathbf{54}b_2$ for the two cylinders $\mathbf{12}b_1$ and $\mathbf{12}b_2$ of the lower second cylinder group 12*b* through fuel supply pipes $\mathbf{69}b_1$ and $\mathbf{69}b_2$.

The first fuel pump 64*a* is mounted at a location slightly lower than the carburetor $\mathbf{54}a_2$ for lower one $\mathbf{12}a_2$ of the two cylinders $\mathbf{12}a_1$ and $\mathbf{12}a_2$ of the first cylinder group 12*a* and therefore, the fuel supply pipes $\mathbf{69}a_1$ and $\mathbf{69}a_2$ extend upwardly from the first fuel pump 64*a* toward the two carburetors $\mathbf{54}a_1$ and $\mathbf{54}a_2$. The second fuel pump 64*b* is mounted at location slightly lower than the carburetor $\mathbf{54}b_2$ for lower one $\mathbf{12}b_2$ of the two cylinders $\mathbf{12}b_1$ and $\mathbf{12}b_2$ of the second cylinder group 12*b* and therefore, the fuel supply pipes $\mathbf{69}b_1$ and $\mathbf{69}b_2$ extend upwardly from the second fuel pump 64*b* toward the two carburetors $\mathbf{54}b_1$ and $\mathbf{54}b_2$.

Figure 4:
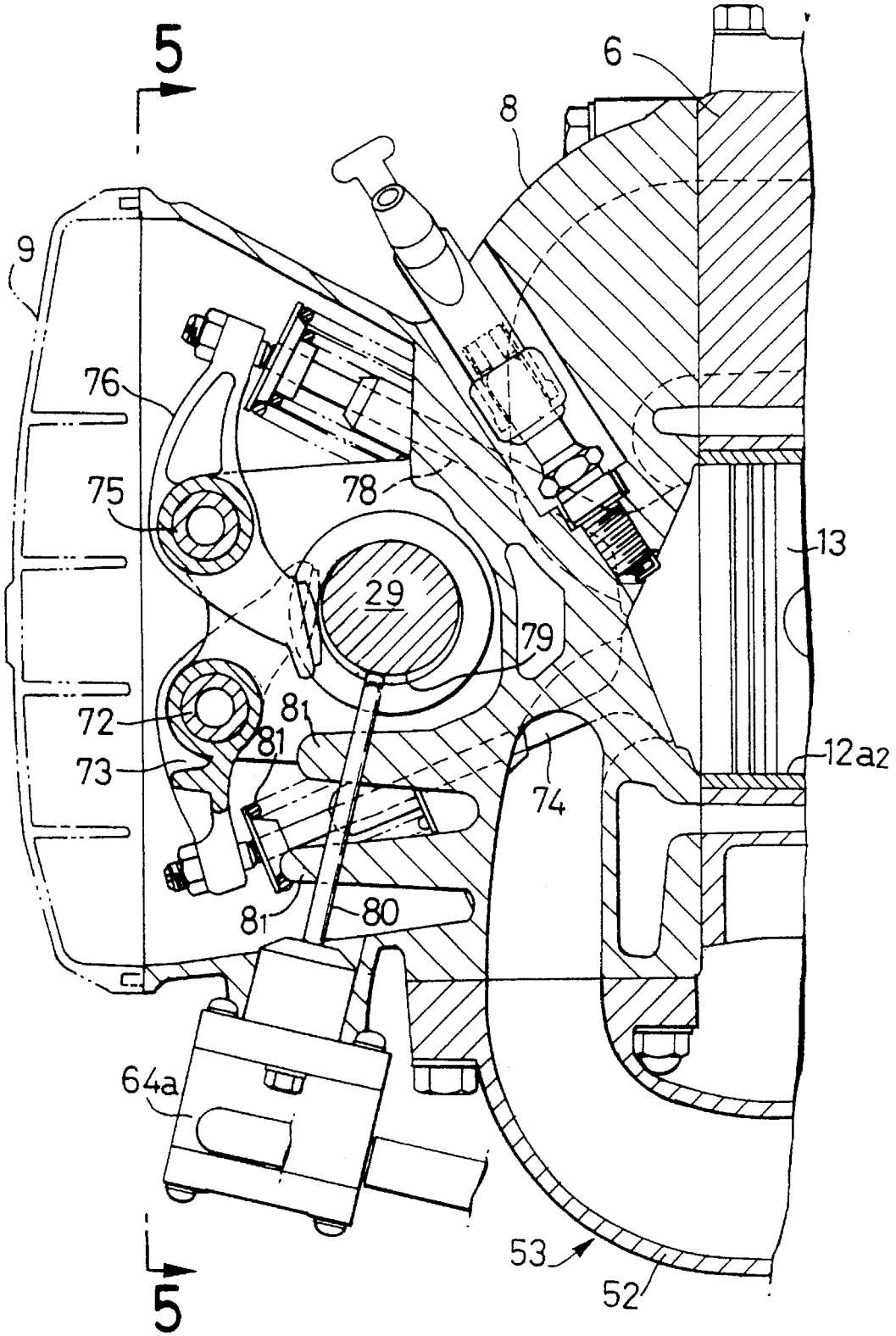
FIG. 4 is a sectional view of a cylinder head.
Figure 5:
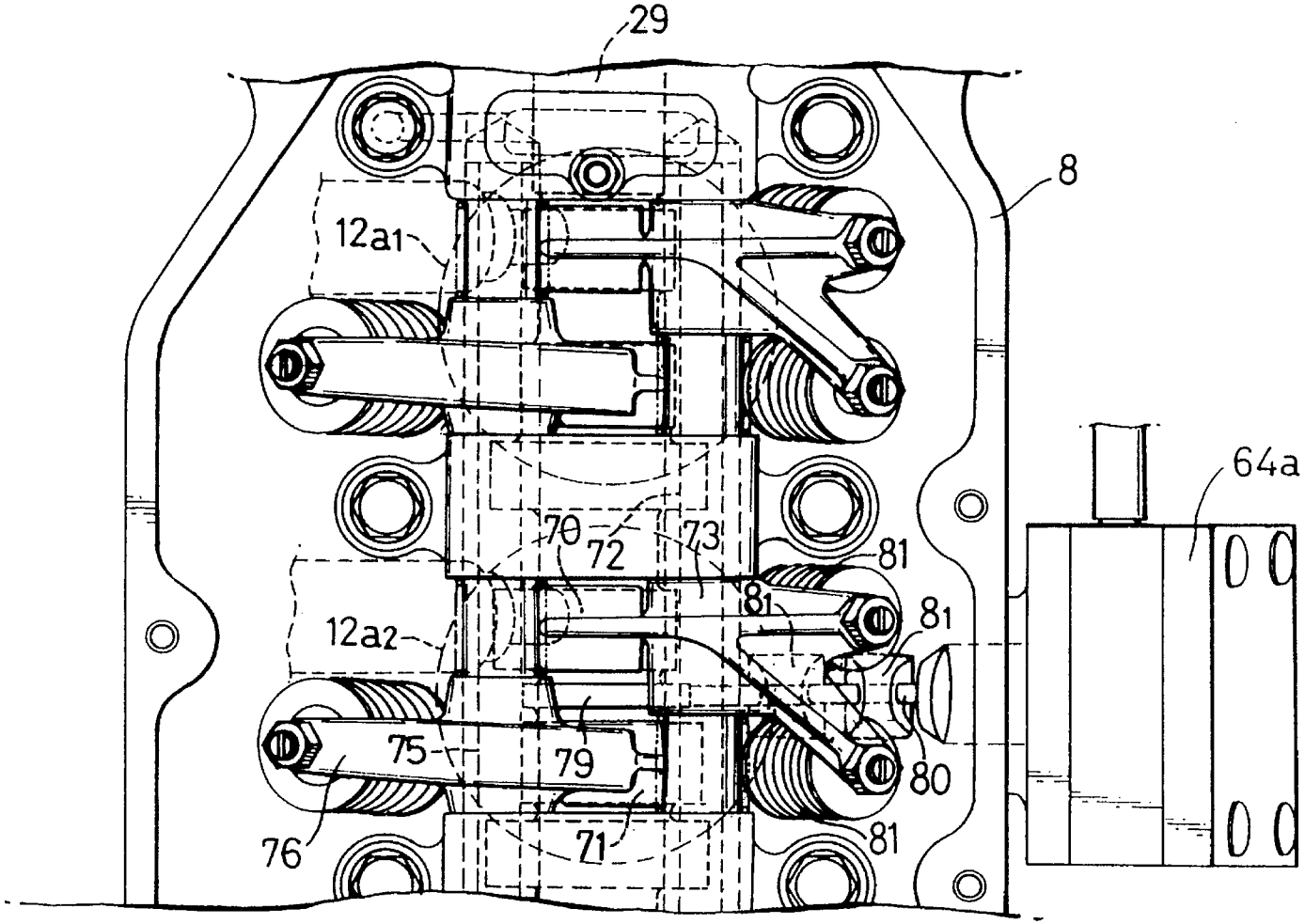
FIG. 5 is a sectional view taken along a line 5—5 in FIG. 4.

The structure of driving systems for the fuel pump 64*a* and 64*b* will be described below with reference to FIGS. 4 and 5. The driving systems for the first and second fuel pumps 64*a* and 64*b* have the same structure and hence, the structure of the driving system for the first fuel pump 64*a* as a representative will be described.

Intake cams 70 and exhaust cams 71 are provided on the cam shaft 29 supported in the cylinder head 8 to correspond to the cylinders $\mathbf{12}a_1$, $\mathbf{12}a_2$, $\mathbf{12}b_2$ and $\mathbf{12}b_2$. Intake rocker arms 73 are pivotally supported on an intake rocker arm shaft 72 to abut against the intake cams 70 and intake valves 74 which are mounted by two for each of the cylinders $\mathbf{12}a_1$, $12a_2$, $12b_1$ and $12b_2$, and exhaust rocker arms 76 are pivotally supported on an intake rocker arm shaft 72 to abut against the exhaust cams 71 and exhaust valves 78 which are mounted by one for each of the cylinders $12a_1$, $12a_2$, $12b_1$ and $12b_2$.

A pump driving cam 79 is provided between the intake cam 70 and the exhaust cam 71 for the cylinder $12a_2$, and a pump driving rod 80 is slidably supported on a pair of supporting portions $8_1$, $8_1$ formed on the cylinder head 8 to abut against the pump driving cam 7. The pump driving rod 80 extends within the first fuel pump 64*a*, where it is connected a plunger (not shown). Thus, the first fuel pump 64*a* can be driven through the pump driving cam 79 and the pump driving rod 80 by the rotation of the cam shaft 29.

The pump driving rod 80 is disposed to pass between valve springs 81, 81 of the two intake valves 74, 74. Thus, the first fuel pump 64*a* can be driven, while avoiding the interference of the pump driving rod 80 with the valve springs 81, 81. Moreover, the interference of the valve springs 81, 81 with the supporting portions $8_1$, $8_1$ can be avoided without an increase in distance between the intake valves 74, 74 by the provision of the pair of supporting portions $8_1$, $8_1$.

Because the interference of the pump driving rod 80 with the valve springs 81, 81 has been avoided as described above, the first and second fuel pumps 64*a* and 64*b* can be disposed at a lengthwise intermediate portion of the cam shaft 29. As a result, the difference of altitude between the cylinder located at a higher level and the fuel pump can be decreased, as compared with the case where the fuel pump mounted at a lower end of the cam shaft 29, and hence, even if the fuel pumps 64*a* and 64*b* having a small size and a small capacity are used, fuel can be reliably supplied to the carburetors $54a_1$, $54a_2$, $54b_1$ and $54b_2$, and the fuel level within a float chamber can be uniform.

The operation of the embodiment of the present invention having the above-described construction will be described below.

When the cam shaft 29 is rotated in operative association with the crankshaft 15 by the operation of the engine E, the pump driving rods 80, 80 abutting against the two pump driving cams 79, 79 are reciprocally moved to drive the first and second fuel pumps 64*a* and 64*b*. This causes the fuel drawn from the fuel tank (not shown) through the fuel filter 65, the fuel supply pipe 66, the joint 67 and the supply pipes 68*a* and 68*b* to be supplied to the carburetors $54a_1$ and $54a_2$ for the two cylinders $12a_1$ and $12a_2$ of the first cylinder group 12*a* by way of the fuel supply pipes $69a_1$ and $69a_2$ connected to the first fuel pump 64*a* and also to the carburetors $54b_1$ and $54b_2$ for the two cylinders $12b_1$ and $12b_2$ of the second cylinder group 12*b* by way of the fuel supply pipes $69b_1$ and $69b_2$, connected to the second fuel pump 64*a*.

On the other hand, air drawn through an air intake bore $4_1$ defined in an upper portion of the engine cover 4 into the second intake silencing chamber 62 through its intake bore $62_1$ is supplied through the first intake silencing chamber 61 to the carburetors $54a_1$, $54a_2$, $54b_1$ and $54b_2$, where the air and fuel are mixed. The resulting mixture is supplied through the intake passages 52 in the intake manifold 53 to the cylinders $12a_1$, $12a_2$, $12b_1$ and $12b_2$.

The first fuel pump 64*a* is provided for the two cylinders $12a_1$ and $12a_2$ of the first cylinder group 12*a* and the second fuel pump 64*b* is provided for the two cylinders $12b_1$ and $12b_2$ of the second cylinder group 12*b*, as described above. Therefore, even if the fuel pumps 64*a* and 64*b* have a small size and a small capacity, the fuel can be reliably supplied to the carburetors $54a_1$, $54a_2$, $54b_1$ and $54b_2$, and moreover, the degree of freedom of layout within the narrow engine room 51 can be increased, as compared with the case where a single large-sized fuel pump is used.

In addition, since the first fuel pump 64*a* is mounted at the location slightly lower than the carburetor $54a_2$ for lower one $12a_2$ of the two cylinders $12a_1$ and $12a_2$ of the first cylinder group 12*a*, the fuel supply pipes $69a_1$ and $69a_2$ can be extended upwardly from the first fuel pump 64*a* toward the two carburetors $54a_1$ and $54a_2$ to prevent the residence of fuel vapors. Likewise, since the second fuel pump 64*b* is mounted at the location slightly lower than the carburetor $54b_2$ for lower cylinder $12b_2$ of the two cylinders $12b_1$ and $12b_2$ of the second cylinder group 12*b*, the fuel supply pipes $69b_1$ and $69b_2$ can be extended upwardly from the second fuel pump 64*b* toward the two carburetors $54b_1$ and $54b_2$ to prevent the residence of fuel vapors.

Further, the first and second fuel pumps 64*a* and 64*b* are disposed along the sidewall of the cylinder head 8 and moreover, the first fuel pump 64*a* is disposed in the vicinity of the corresponding cylinder group 12*a*, while the second fuel pump 64*b* is disposed in the vicinity of the corresponding cylinder group 12*b*. Therefore, the difference of altitude between the first and second fuel pumps 64*a* and 64*b* and the cylinders $12a_1$ and $12b_1$ disposed at higher locations can be minimized, and the length of the fuel supply pipes $69a_1$, $69a_2$, $69b_1$ and $69b_2$ can be also minimized.

Figure 6:
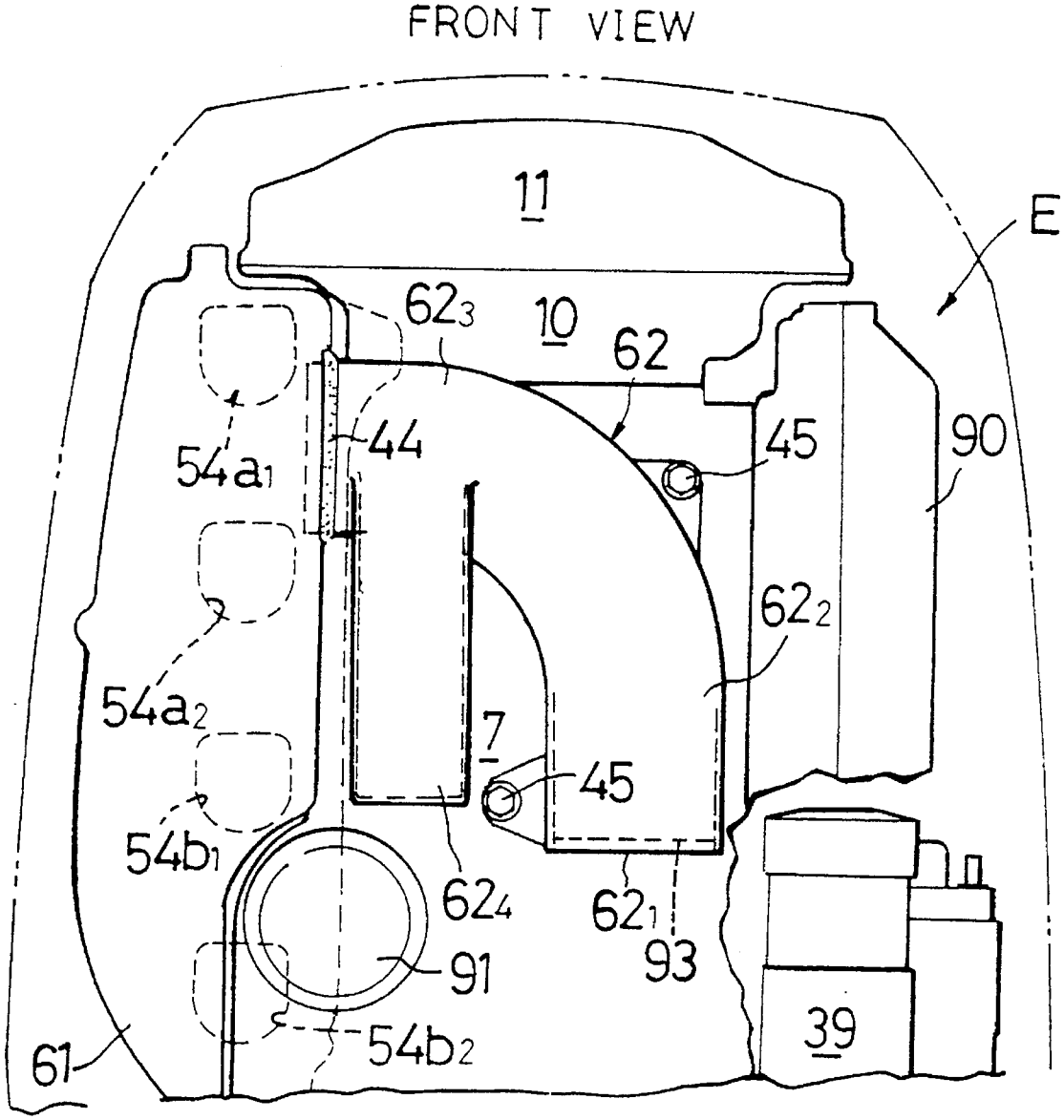
FIG. 6 is a view similar to FIG. 3, but illustrates an intake silencer according to a second embodiment of the present invention.

FIG. 6 shows a second embodiment of the present invention. A second intake silencing chamber 62 in this embodiment is of a resonance chamber type including a resonance chamber $62_4$ which diverges from a duct portion. In FIG. 6, reference character 93 is a mesh (i.e., flame trap) made of a stainless steel.

Figure 7:
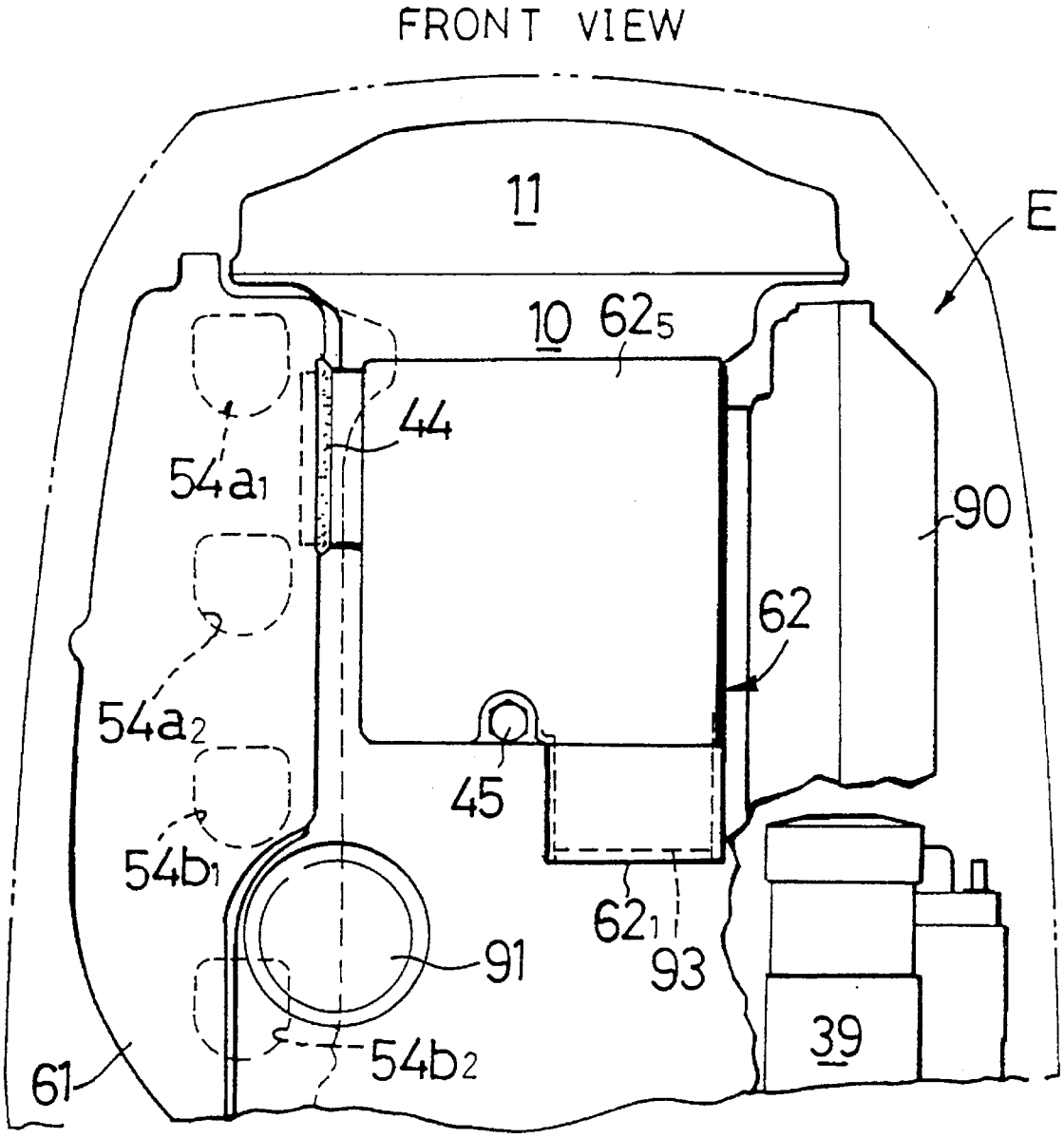
FIG. 7 is a view similar to FIG. 3, but illustrates an intake silencer according to a third embodiment of the present invention.

FIG. 7 shows a third embodiment of the present invention. A second intake silencing chamber 62 in this embodiment is of an expansion chamber type including an expansion chamber $62_5$ of a large volume.

Although the embodiments of the present invention have been described in detail, it will be understood that the present invention is not limited to the above-described embodiments, and various modifications in design may be made without departing from the spirit and scope of the invention defined in the claims.

For example, although the serial 4-cylinder engine E of the outboard motor O has been exemplified in the above-described embodiments, the present invention is applicable to an engine other than for the outboard motor, and also to a V-type engine and a multi-cylinder engine other than a 4-cylinder engine. Further, the present invention is also applicable to a fuel injection type engine having no carburetors $54a_1$, $54a_2$, $54b_1$ and $54b_2$. Additionally, the first intake silencing chamber 61 may be disposed along the left side of the crankcase 7, and in a V-type engine, a pair of first intake silencing chambers may be disposed along left and right opposite sides of the crankcase. Other embodiments are possible, not enumerated above, which may still be within the spirit and scope of the invention, as set forth in the appended claims.

We claim:

1. An intake silencer of a vertical-type engine, with the engine having a crankshaft vertically disposed in an engine body thereof, said engine body having a cylinder head and being accommodated in an engine compartment, said intake silencer comprising:

a first intake silencing chamber disposed adjacent said engine body, said first intake silencing chamber receiving a flow of intake air therethrough;

a second intake silencing chamber located upstream in said flow of intake air from said first intake silencing chamber, said second intake silencing chamber receiving said flow of intake air as an input thereto, with an output of said second intake silencing chamber becoming an input to said first intake silencing chamber, wherein said second intake silencing chamber is disposed along an opposite end of the engine body from the cylinder head.

2. An intake silencer as recited in claim 1, said second intake silencing chamber comprising:

a first portion having a lower end which is opened downwardly toward said engine compartment, said first port ion extending upwardly from said opened lower end, and a second portion attached to said first portion, said second portion curving or bending horizontally from said first portion, and being connected to said first intake silencing chamber.

3. An intake silencer as recited in claim 1, said first intake silencing chamber including coupling means for coupling said first intake silencing chamber to at least one fuel delivery device attached to the engine, said coupling means being disposed downstream from said second intake silencing chamber.

4. An intake silencer in a vertical type engine as recited in claim 1, wherein said second intake silencing chamber includes a first intake opening for receiving a first part of the flow of intake air therein, and a second intake opening for receiving a second part of the flow of intake air therein, said first and second intake openings providing the flow of intake air toward the first intake silencing chamber.

5. An intake silencer as recited in claim 1, wherein said second silencing chamber includes an opening having a first cross sectional area, and a secondary chamber, said secondary chamber being disposed downstream from said intake opening and upstream from said first intake silencing chamber, said secondary chamber having a second cross sectional area which is greater than said first cross sectional.

6. An intake silencer as recited in claim 1, wherein at least one of said first intake opening and said second intake opening receive the first part of the flow of intake air or the second part of the flow of intake air from a lower end thereof which is opened in a downward direction.

7. An intake silencer as recited in claim 5, wherein said opening of said second silencing chamber is opened downward, at a lower portion thereof.

8. An intake silencer as recited in claim 3, wherein said at least one fuel delivery device is a carburetor.

9. An intake silencer as recited in claim 3, wherein said at least one fuel delivery device is a fuel injection unit.

10. An intake silencer of a vertical-type engine, which is provided in the engine having a crankshaft vertically disposed therein and which is accommodated in an engine compartment, said intake silencer comprising, a first intake silencing chamber located downstream in a direction of flow of an intake air; and a second intake silencing chamber located upstream in said flow direction, said first intake silencing chamber being disposed along a side of an engine body, and said second intake silencing chamber being disposed along an opposite end of the engine body from a cylinder head, said opposite end being different from the side of the engine body having the first intake silencing chamber disposed thereon.

* * * * *